US008267288B2

(12) United States Patent
Atkinson

(10) Patent No.: US 8,267,288 B2
(45) Date of Patent: Sep. 18, 2012

(54) DEVICE TO HELP WITH DRESSING

(76) Inventor: Harold Richard Atkinson, Leeston (NZ)

( * ) Notice: Subject to any disclaimer, the term of this patent is extended or adjusted under 35 U.S.C. 154(b) by 234 days.

(21) Appl. No.: 12/696,077

(22) Filed: Jan. 29, 2010

(65) Prior Publication Data

US 2010/0193554 A1 Aug. 5, 2010

(51) Int. Cl.
*A47G 25/80* (2006.01)

(52) U.S. Cl. ..... 223/111

(58) Field of Classification Search ..... 223/111, 223/119, 112, 120
See application file for complete search history.

(56) References Cited

U.S. PATENT DOCUMENTS

| | | | | |
|---|---|---|---|---|
| 975,246 | A * | 11/1910 | Johnson | 223/111 |
| 3,993,228 | A | 11/1976 | Fuhr | |
| 4,966,316 | A | 10/1990 | George | |
| 5,249,720 | A | 10/1993 | White | |
| 5,636,774 | A | 6/1997 | Moscato | |
| 5,687,889 | A | 11/1997 | Liden | |
| 5,894,970 | A * | 4/1999 | Belkin et al. | 223/112 |
| 5,924,610 | A | 7/1999 | Willemin | |
| 6,234,370 | B1 * | 5/2001 | Kummerle et al. | 223/112 |
| 7,070,074 | B2 * | 7/2006 | Landsberger et al. | 223/113 |
| 2002/0139819 | A1 * | 10/2002 | Ferraioli | 223/111 |
| 2007/0095866 | A1 * | 5/2007 | Zumbach | 223/111 |
| 2008/0110945 | A1 * | 5/2008 | Cookman | 223/111 |
| 2009/0039118 | A1 | 2/2009 | Whitlaw | |
| 2010/0096418 | A1 * | 4/2010 | Cockman | 223/111 |

FOREIGN PATENT DOCUMENTS

| | | | |
|---|---|---|---|
| CA | 2641368 | | 5/2009 |
| DE | 29717153 | | 11/1997 |
| DE | 20306424 | | 8/2003 |
| DE | 102008023102 | | 11/2009 |
| FR | 2785783 | | 5/2000 |
| JP | 2003219954 | | 8/2003 |
| JP | 2006015103 | | 1/2006 |
| WO | WO2004023944 | * | 3/2004 |

* cited by examiner

*Primary Examiner* — Shelley Self
*Assistant Examiner* — Andrew Sutton
(74) *Attorney, Agent, or Firm* — Galbreath Law Offices, P.C.; John A. Galbreath

(57) ABSTRACT

A device for helping with dressing, the device including a support; wherein the support includes a base provided with a pair of opposed arms spaced apart by a first predetermined distance and extending from the base such that when the base is supported upon a substantially horizontal supporting surface, the arms extend upwards from the base; each of the arms having a first side and a second side, said first and second sides being spaced apart in the plane of the arm by a second predetermined distance; each of the arms being secured to the base along a first edge; and wherein said first and second predetermined distances are selected so as to enable said arms to hold the waistband of a garment open when the garment is placed over said arms.

9 Claims, 7 Drawing Sheets

DEVICE TO HELP WITH DRESSING

TECHNICAL FIELD

The present invention relates to a device to assist a disabled person to dress, and in particular to assist in putting on trousers or underwear or incontinence pants.

People who have limited flexibility (for example, because of a back or leg injury) can find it extremely difficult to bend sufficiently to put on trousers or underwear or specialised items of underwear such as incontinence pants.

Incontinence pants are particularly difficult to put on if a person has limited flexibility, because to function effectively, incontinence pants must be tight fitting, and usually are elasticated around the waist and leg holes. Incontinence pants have to be changed frequently, and many people find it humiliating to have to ask for assistance.

The present invention has been designed for use in putting on incontinence pants, and will be described with particular reference to this application. However, it will be appreciated that the device of the present invention also is very useful for assisting with putting on trousers or shorts or conventional underpants or knickers, and could also be used to assist with putting on a skirt.

BACKGROUND ART

Any discussion of the prior art throughout this specification is not an admission that such prior art is widely known or forms part of the common general knowledge in the field.

A number of earlier inventions have dealt with the problem of putting on socks or stockings:—see for example U.S. Pat. No. 5,636,774, U.S. Pat. No. 5,249,720, U.S. Pat. No. 5,769,289 and Canadian Patent Application 2641368. However, none of these devices can be used for putting on trousers or underwear or incontinence pants:—they function only for socks or stockings.

US Patent Application 2009/0039118 relates to a device for putting on underwear or trousers, and essentially consists of a length of cord, the free ends of which carry grippers which are secured to the waistband of the garment to be pulled on. The user attaches the grippers to the waistband and then, while sitting, manoeuvres his feet into the leg holes and pulls on the cord to draw the garment up his legs until he can grip the waistband himself. A device of this type is likely to be suitable only for relatively loose fitting garments, because pulling a tight fitting garment (such as incontinence pants) in this way would require an extremely strong grip on the waistband, and put a great deal of strain on the waistband; damage to the pants would be likely to result. Another potential problem is that a person using this device has to keep guiding their legs through the leg holes down the full length of the garment, on both sides simultaneously, and raising both legs to do this can be difficult for a person with limited flexibility.

OBJECT OF INVENTION

An object of the present invention is the provision of a device for helping a person of limited flexibility with dressing, which overcomes the above described disadvantages or at least provides a useful choice.

DISCLOSURE OF INVENTION

The present invention provides a device for helping with dressing, the device including a support; wherein the support includes a base provided with a pair of opposed arms spaced apart by a first predetermined distance and extending from the base such that when the base is supported upon a substantially horizontal supporting surface, the arms extend upwards from the base; each of the arms having a first side and a second side, said first and second sides being spaced apart in the plane of the arm by a second predetermined distance; each of the arms being secured to the base along a first edge; and wherein said first and second predetermined distances are selected so as to enable said arms to hold the waistband of a garment open when the garment is placed over said arms.

Each arm may be one-piece or two-piece. In the (preferred) one-piece construction, each arm is a single component providing said first and second sides. However, a two-piece construction is also possible, in which each arm consists of two spaced components which respectively provide the first and second sides of the arm.

Preferably, each of the arms is formed with a notch on the first side of said arm, at or adjacent the edge opposite to said first edge.

Preferably also, the portion of said first side of each arm below said notch slopes away from said second side.

Preferably also, the second side of each said arm provides a first portion which slopes away from said first side and an undercut portion which slopes towards said first side, the undercut portion being adjacent said first edge of the corresponding arm.

Preferably, the support is provided with a cord secured to the base at a position remote from said arms.

The arms may be formed integrally with said base or may be formed separately from said base and either rigidly secured thereto or hinged thereto. If the arms are formed separately from the base, they may be secured to the base such that their position is adjustable relative to the base, so that said first predetermined distance can be varied to accommodate different sizes.

BRIEF DESCRIPTION OF DRAWINGS

By way of example only, a preferred embodiment of the present invention is described in detail with reference to the accompanying drawings, in which:—

BEST MODE FOR CARRYING OUT THE INVENTION

Figure 1:
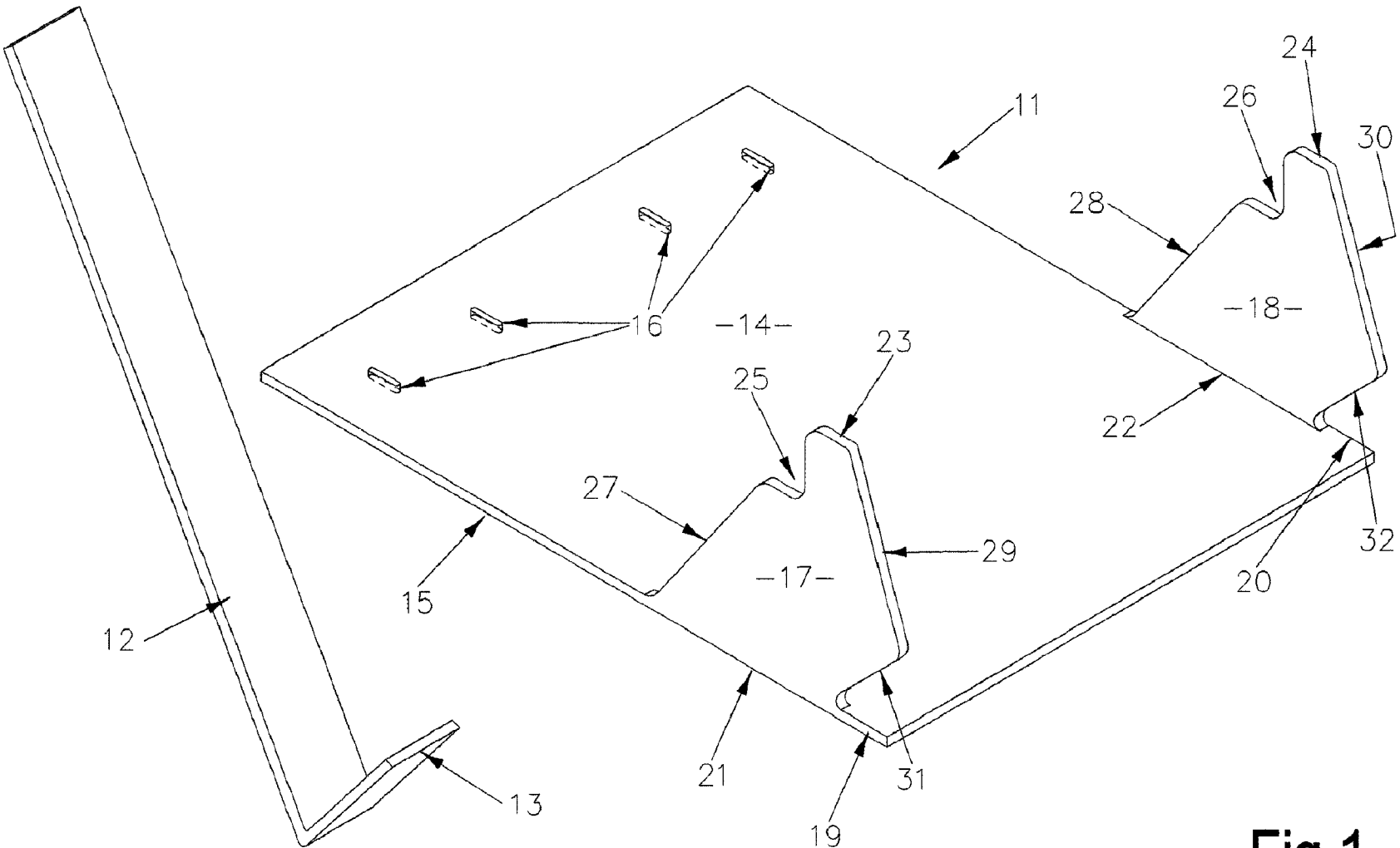
FIG. 1 is an isometric view of a support and a long handled hook in accordance with the present invention.

Referring to the drawings, a device for helping with dressing consists of a support 11 and a long handled hook 12. The hook 12 is shown as being made from folded flat sheet, but any long handled hook could be used, providing the end 13 of the hook is blunted or protected to avoid injury to the user and/or the garment being put on. Alternatively, the commercially available long handled gripping tools, or long handled tongs could be used.

The support 11 includes a base 14 which is flat on its underside 15 and is formed near one end with a series of spaced slots 16 through which a cord (not shown in FIG. 1) is threaded to assist a user in positioning the device. Near the other end of the base 14, a pair of spaced, opposed arms 17,18 are secured, with one arm adjacent each longitudinal edge 19,20 of the base 14. The arms 17,18 are depicted as being formed integrally with the base 14, but could also be formed separately. The arms 17,18 could also be hinged to the base 14 along their first, lower, edges 21,22, so that the arms can be folded flat for storage. However, if the arms are hinged to the base in this manner, the hinging must be such that when the arms are hinged away from the board to the position shown in FIG. 1, the arms are held firmly in that position.

The arms 17,18 are positioned such that when the base 14 is supported upon a substantially horizontal supporting surface (generally the floor) the arms 17,18 extend outwards and upwards from the base 14. The planes of the arms 17,18 can be parallel to each other, but need not be. If the arms 17,18 are formed rigidly with the base, it is preferable if the arms 17,18 incline away from each other slightly, to permit multiple supports being stacked on top of each other for freight.

The exact angle between the plane of each of the arms 17,18 and the plane of the base 14 is not critical:—the arms simply need to extend upwards and outwards from the base.

Each arm 17,18, has a first edge 21,22 (which is the "lower" edge in the device is in use), along which the arm is secured to the base 14, and a second edge 23,24 which in use is furthest from the base 14, (i.e. the "upper" edge in use). A short distance below each upper edge 23,24, each arm is formed with a notch 25,26 in a first side 27,28 of the arm. The remaining portion of the first side 27,28 of each arm is at an angle slightly less than 90° to the corresponding first edge 21,22, to provide a smoothly sloping surface over which a garment can be spread as hereinafter described.

The second side 29,30 of each arm is inclined at an acute angle to the corresponding first edge 21,22 for most of its length, but immediately above the corresponding first edge 21,22, the second side 29,30 is formed with an undercut portion 31,32, which is at or near a right angle to the major portion of the length of the second side.

The shape of each of the arms is designed firstly to stretch a garment open and to hold it in the position where a user can start to put the garment on:—this means that the arms must not only stretch the waistband open but must also hold the back and front of the waistband apart, so it is easy for a user to put his feet into the garment. Secondly, the shape of the arms must allow a garment to be slipped off the arms easily, without undue force being required by the user, or any risk of damage to the garment, when the garment is being pulled up by the hook as described below.

It should be noted that although the drawings depict the arms 17,18 at one end of the base 14, the arms could in fact be positioned anywhere along the length of the base 14.

Figure 2:
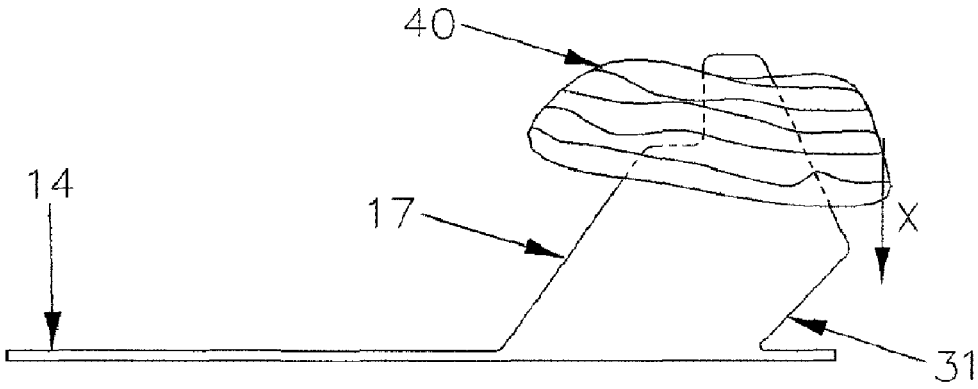
FIG. 2 is a side view of the support with incontinence pants placed on the arms.
Figure 3:
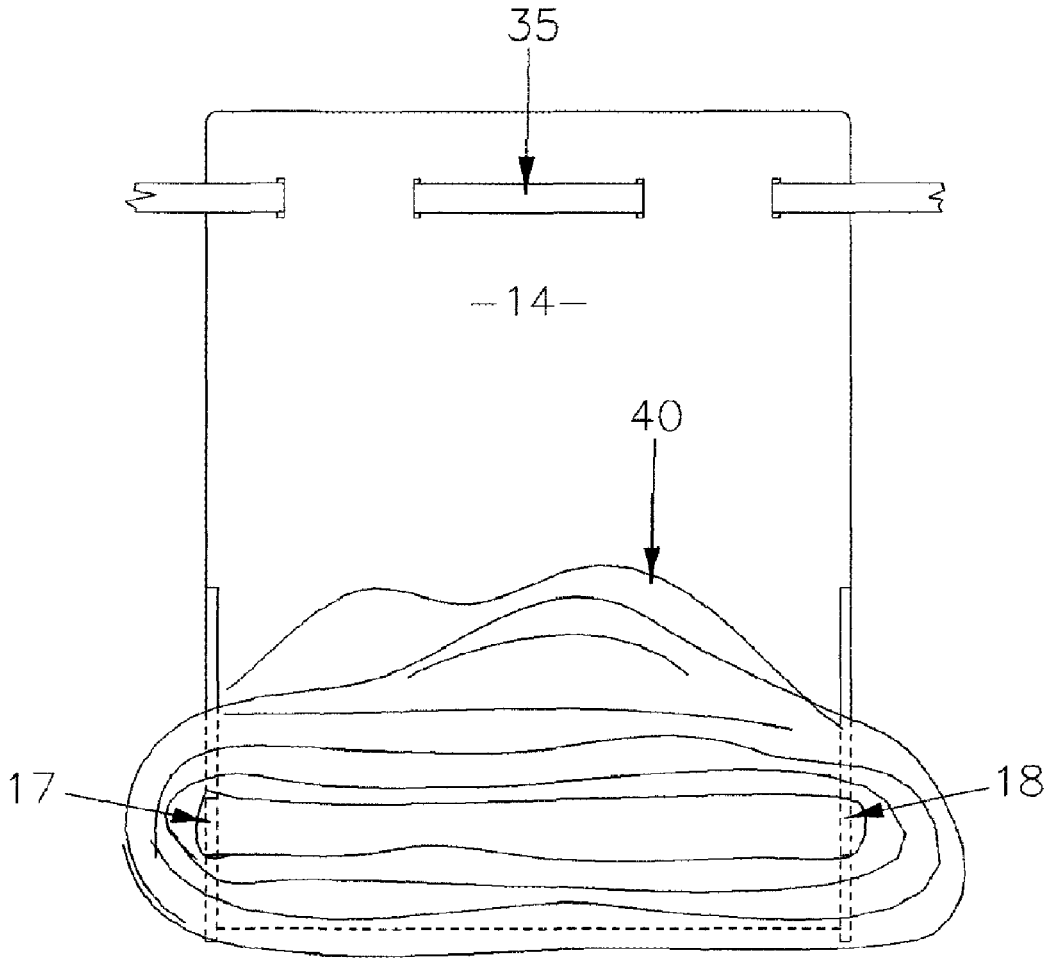
FIG. 3 is a plan view of the support of FIG. 2.

The above described device is used as follows: —the first step is for the user to set on a suitable seat and to place the incontinence pants 40 on the arms 17,18 in the position shown in FIGS. 2 and 3. In this position, the front of the pants is adjacent the notches 25,26 in the arms, the waistband of the pants is stretched so that one arm 17 extends through one leg hole of the pants, and the other arm 18 extends through the other leg hole, with the waistband supported by the notches 25,26. The rear of the pants is then pulled downwards in the direction of Arrow X in FIG. 2 until the rear of the pants lies in the undercut portions 31,32, as shown in FIG. 4.

The support 11 is then placed in front of the user, with the arms 17,18 close to the users feet and the base 14 supported on a flat secure nonslip surface. The user steadies the device and controls its position by means of the cord 35 (FIGS. 3 and 4 only) which is threaded through the slots 16 in the base 14.

Figure 4:
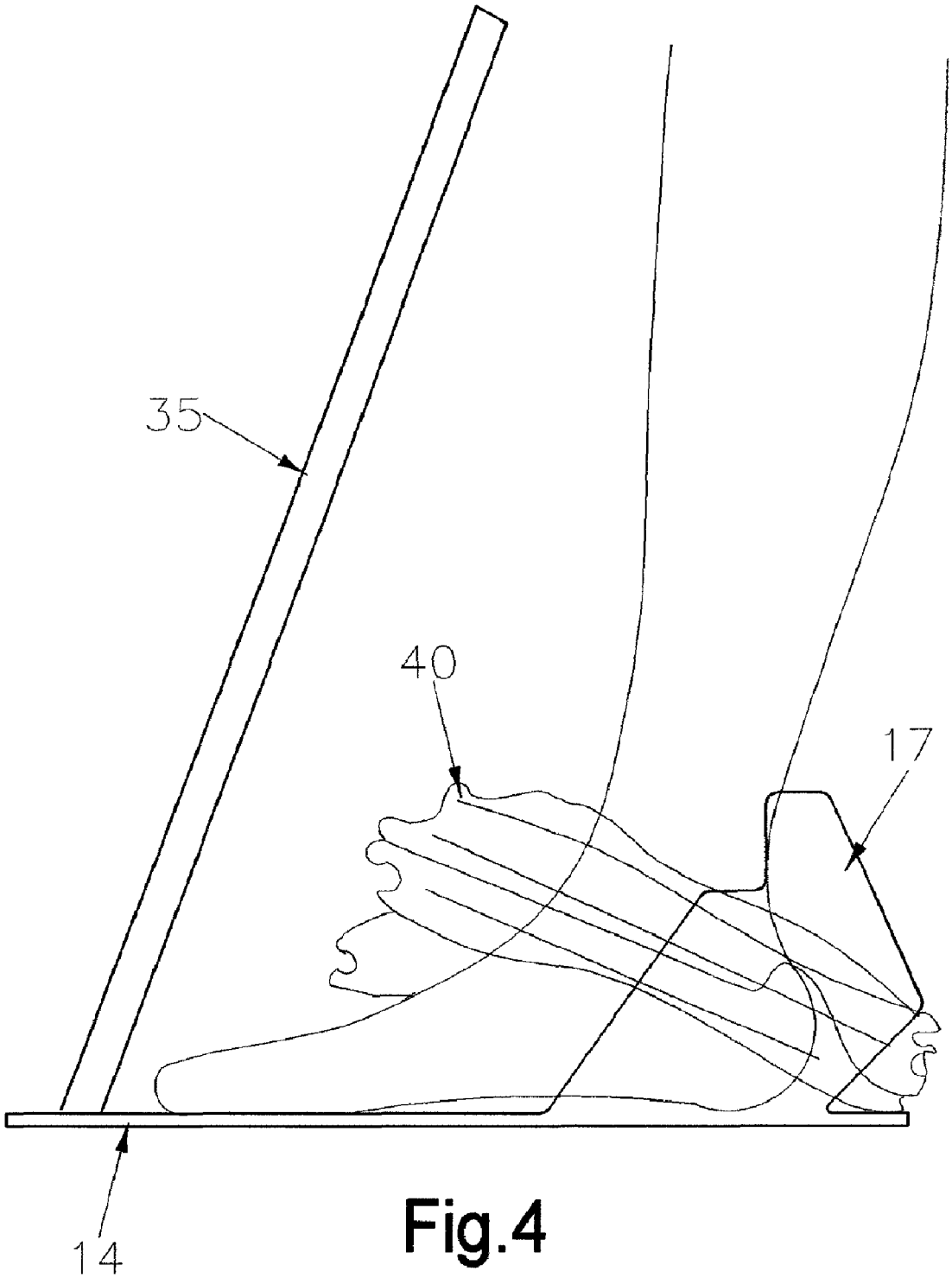
FIGS. 4-6 are diagrammatic side views showing the sequence adopted by a user in putting on a pair of incontinence pants using the device of the present invention; in these Figures, the support and the pants are depicted as transparent, for clarity.

From this position, the user inserts first one foot and then the other through the corresponding leg hole of the pants, so that the toes of each foot are visible in front of the pants, as shown in FIG. 4.

Figure 5:
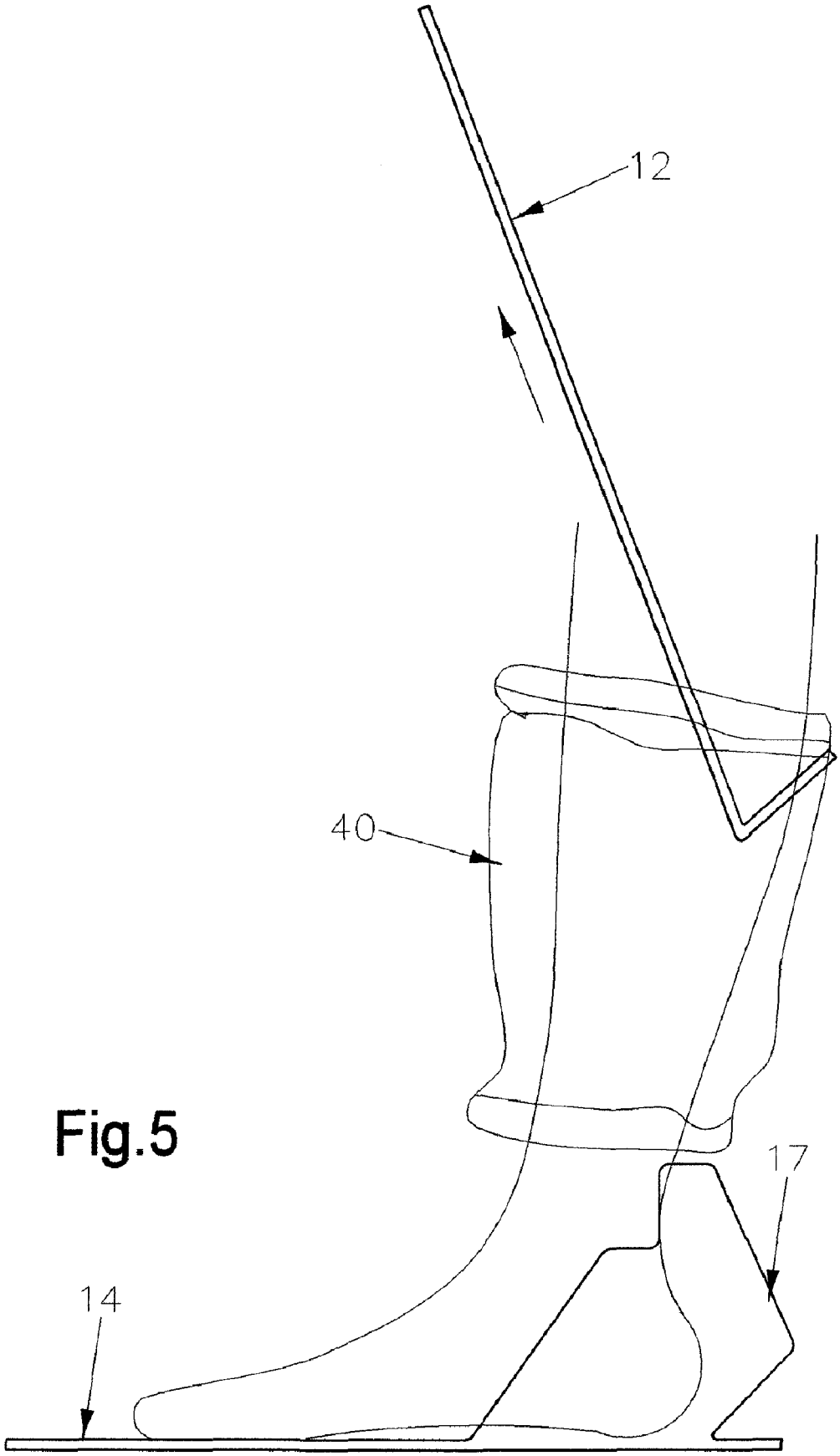
Figure 6:
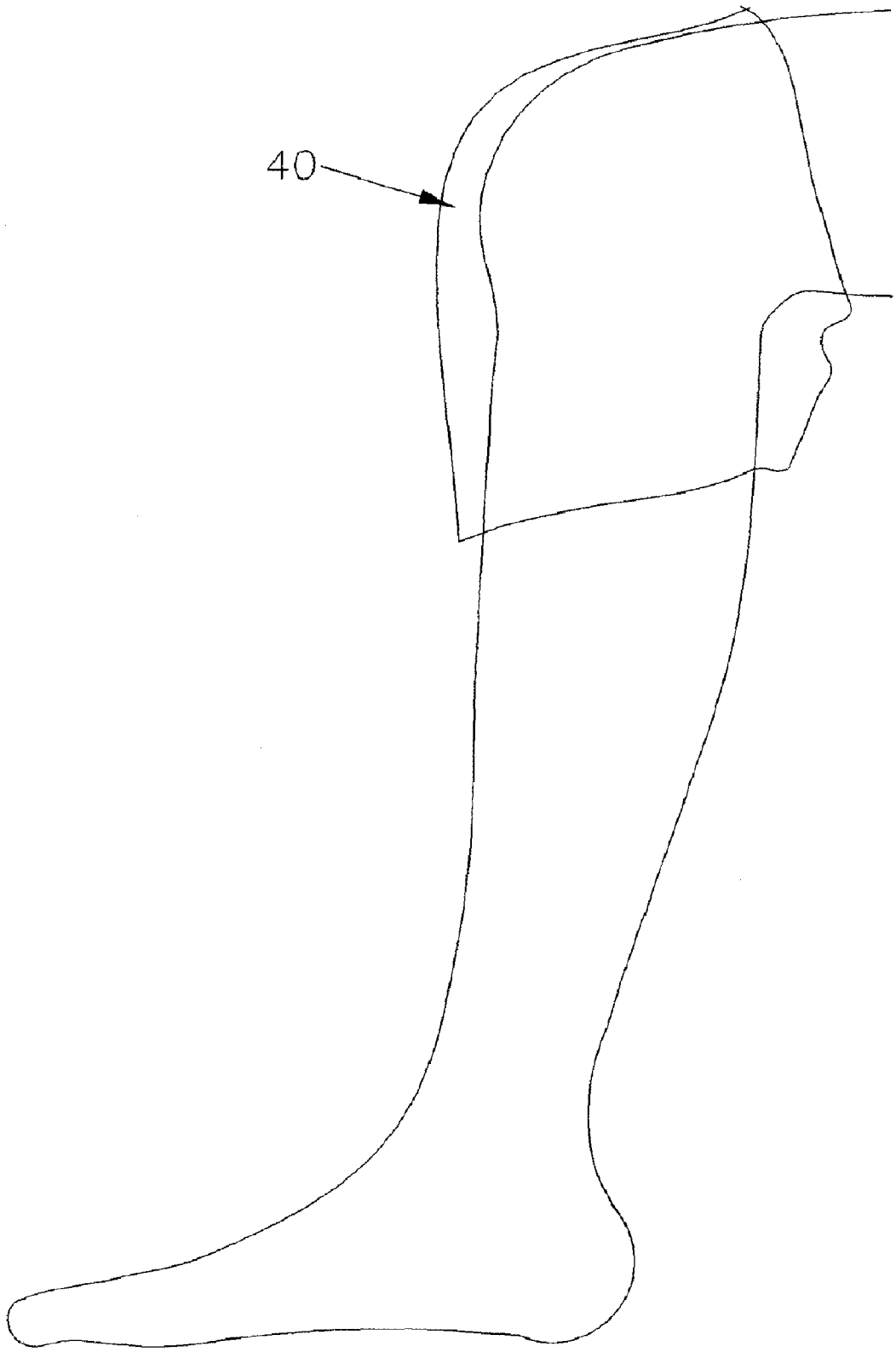

The user then steadies the support 11 by means of the cord 35 and slides both feet as far forward as possible, so that the heels are clear of the rear of the pants. The user then raises both heels and lowers the long handle of 12 between his knees to engage the hook with the rear waistband of the pants. The user then draws the hook slowly upwards, to lift the pants off the arms 17,18 and draw the pants up his legs, first to the position shown in FIG. 5 and then over his knees to the position shown in FIG. 6.

The support 11 is moved out of the way as soon as the pants are fully released from the arms 17,18.

Once the pants' waistband is at or slightly over the user's knees, most users can grasp the waistband in their hands and pull the pants further up. The user then stands to draw the pants into the proper position.

It will be appreciated that the same sequence of events is used if the user is putting on trousers or shorts or conventional underwear or a skirt.

The cord 35 can be used to hang up the support 11 when not in use; the long handled hook can also be fitted with a cord, for easier handling and for hanging up, at the unhooked end.

The device of the present invention may be made of any suitable strong and impact resistant material, e.g. sheet metal or a suitable plastic material such as polycarbonate. The drawings depict the device made from sheet material but it would of course be possible to make the device as a frame, for example from shaped tube.

The arms 17,18, need to be spaced apart sufficiently to hold the waistband of the garment sufficiently spread out to make it easy for a user to put his feet through the leg holes of the garment (or, in the case of a skirt, through the waistband). If the arms 17,18 are too close together, the waistband will not be held on the upper part of the arms and the whole garment will tend to flop down around the lower part of the arms and be difficult for the user to put on. However, if the arms 17,18, are too far apart, the waistband will be tightly stretched around them, making it difficult to put the garment over the arms and also making it difficult to pull the garment off the arms.

To allow for these variations, the device may be made in a series of sizes with different arm spacings, so that the user would purchase the size of device with an arm spacing appropriate for the user's waist size. Another possibility is to make the device with arms 17,18 one or both of which can be repositioned to provide any of a number of different spacings, to accommodate different sizes. Additionally, or alternatively, the arms 17,18, could be spring-loaded to bias them outwards to ensure a firm grip of the waistband of the garment, but it should be noted that too high a degree of spring loading would make it difficult to remove the garment from the arms.

If the device is used primarily for assisting with putting on trousers or skirts, it would be advantageous to increase the height of each of the arms 17,18, so that the extra length of the arms can accommodate the additional fabric.

Figure 7:
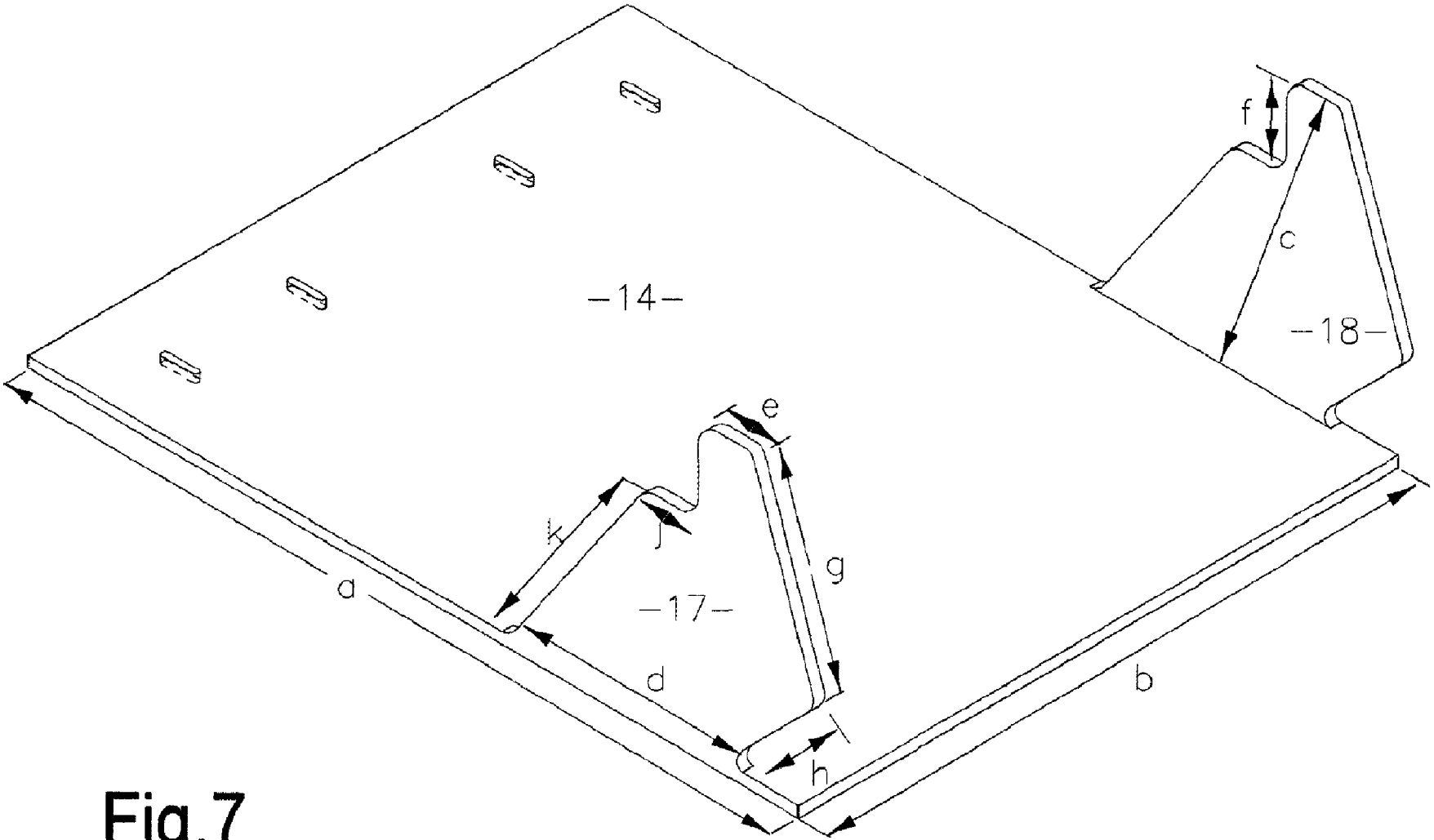
FIG. 7 is a side view of one of the arms of the device of FIGS. 1-6.

If the device is to be used primarily for assisting with putting on incontinence pants, then the dimensions and proportions shown in FIG. 7 and set out in the table below have been found to be particularly effective.

Figure 8:
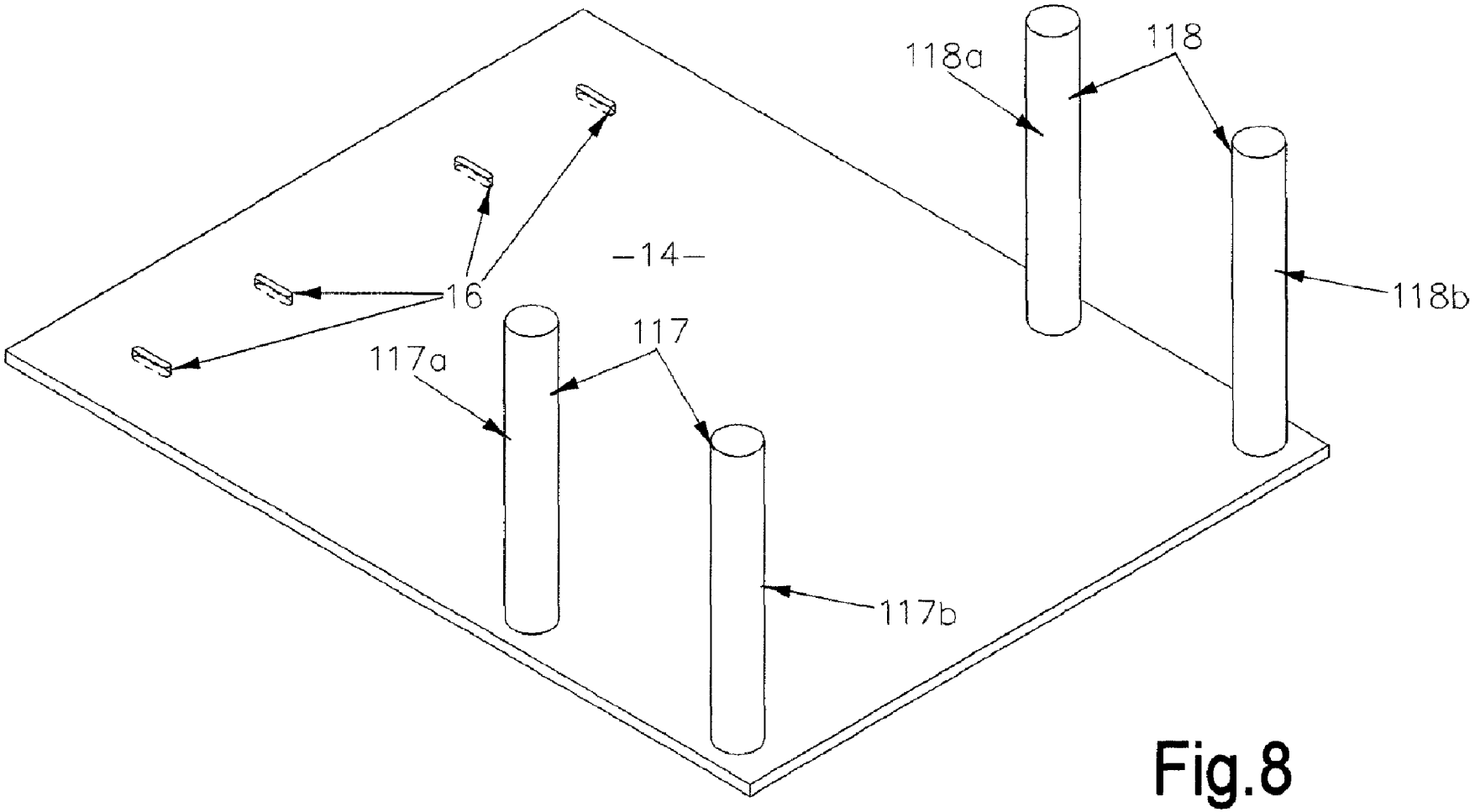
FIG. 8 is an isometric view of another embodiment of the invention.

Overall length a of base 14—36 cm
overall width b of base 14—28 cm
height c of each of the arms 17,18—13 cm
length of first edge d of each arm 17,18—11 cm
length of second edge e of each arm 17,18—2.5 cm
depth f of notch 25,26—4 cm
length g of upper part of second side 29,30 of each arm—9.5 cm
length h of undercut 31,32—6 cm.
width j of notch 25,26—2.5 cm
length k of first side portion 27,28 of each arm—11 cm FIG. 8 illustrates the simplest possible embodiment of the invention, in which the one-piece arms 17,18 of the embodiment of FIGS. 1-7 are replaced by two-piece arms 117 and 118. Each arm, 117,118 is formed from a pair of spaced uprights with the spacing between the outermost edges of the uprights equal to the overall width of the corresponding arm. Thus, for each arm the first upright 117*a*, 118*a* forms the first side of the arm, and the second upright 117*b*,118*b*, forms the second side of the arm. The uprights may be shaped to provide equivalent features to the arms 17,18, i.e. to provide an equivalent to the notches 25,26, the undercuts 31,32 and the sloping sides 27,28,29 and 30. This embodiment is used in the same manner as the embodiment of FIGS. 1-7.

The invention claimed is:

1. A device for helping with dressing, the device including a support;

wherein the support includes a base provided with a pair of opposed arms spaced apart by a first predetermined distance which provides a clear space between the arms; said arms extending from the base such that when the base is supported upon a substantially horizontal supporting surface, the arms extend upwards from the base; each of the arms being secured to the base along a first edge of said arm; each of the arms having a first side and a second side, said first and second sides being spaced apart in the plane of the arm by second predetermined distances; said first side of each arm being formed with a notch at or adjacent the edge of the arm opposite to said first edge, and said second side of each arm being formed with an undercut portion which slopes towards said first side of the arm, the undercut portion being adjacent said first edge of the corresponding arms; and wherein said first and second predetermined distances are selected so as to enable said arms to hold the waistband of a garment open when the garment is placed over said arms.

2. The device as claimed in claim 1, wherein the portion of said first side of each arm below said notch slopes away from said second side.

3. The device as claimed in claim 2, wherein the second side of each said arm provides a first portion which slopes away from said first side and an undercut portion which slopes towards said first side, the undercut portion being adjacent said first edge of the corresponding arm.

4. The device as claimed in claim 1, wherein the support is provided with a cord secured to the base at a position remote from said arms.

5. The device as claimed in claim 1, wherein said first pre-determined distance can be varied by adjusting the position of one or both of the arms relative to the base.

6. The device as claimed in claim 1, wherein the arms are formed integrally with the base.

7. The device as claimed in claim 1, wherein the arms are hinged to the base.

8. The device as claimed in claim 1, wherein each arm is a single component providing said first and second sides.

9. The device as claimed in claim 1, wherein each arm consists of two spaced components which respectively provide said first and second sides of the arm.

* * * * *